US005209696A

United States Patent [19]

Rasmussen et al.

[11] Patent Number: 5,209,696

[45] Date of Patent: May 11, 1993

[54] COIN SORTING MECHANISM

[75] Inventors: James M. Rasmussen, Chicago; Joseph J. Geib, Des Plaines; Douglas U. Mennie, Barrington, all of Ill.

[73] Assignee: Cummins-Allison Corp., Mt. Prospect, Ill.

[21] Appl. No.: 828,375

[22] Filed: Jan. 30, 1992

Related U.S. Application Data

[63] Continuation of Ser. No. 614,611, Nov. 13, 1990, Pat. No. 5,106,338, which is a continuation-in-part of Ser. No. 323,271, Mar. 14, 1989, Pat. No. 5,009,627.

[51] Int. Cl.[5] ..... G07D 3/06

[52] U.S. Cl. ..... 453/10; 453/12

[58] Field of Search ..... 453/3, 6, 10, 12, 32

[56] References Cited

U.S. PATENT DOCUMENTS

| | | | |
|---|---|---|---|
| 4,543,969 | 10/1985 | Rasmussen | 453/10 |
| 4,549,561 | 10/1985 | Johnson et al. | 453/10 |
| 4,570,655 | 2/1986 | Raterman | 453/10 |
| 4,731,043 | 3/1988 | Ristuedt et al. | 453/6 |
| 4,753,624 | 6/1988 | Adams et al. | 453/10 |
| 4,775,354 | 10/1988 | Rasmussen et al. | 453/10 |
| 5,009,627 | 4/1991 | Rasmussen | 453/10 |
| 5,011,455 | 4/1991 | Rasmussen | 453/10 |
| 5,022,889 | 6/1991 | Ristuedt et al. | 453/6 |
| 5,104,353 | 4/1992 | Ristuedt et al. | 453/6 |

FOREIGN PATENT DOCUMENTS

| | | | |
|---|---|---|---|
| 650871 | 8/1985 | Switzerland | 453/6 |

*Primary Examiner*—Michael S. Huppert
*Assistant Examiner*—William M. Hienz
*Attorney, Agent, or Firm*—Arnold, White & Durkee

[57] ABSTRACT

An improved coin sorter sorts coins of at least a first and second denomination according to their denominations. The first coin denomination defines coins which are thicker and wider than the coins of the second denomination. The coin sorter includes a rotatably mounted coin carrying disk having a resilient surface onto which coins may be fed, a mechanism for rotating the coin carrying disk, and a guideplate having a central opening in a configured surface positioned closely adjacent to the disk and over the resilient surface. The configured surface includes an inner recess area for receiving coins of all denominations from the central opening and for allowing those coins to move radially outward. The configured surface further includes a channel area, responsive to the outwardly moving coins, having a width wider than the width of the coins of the first denomination and a depth and opposing walls arranged and constructed such that nonstacked coins of the first and second denominations are respectively guided along and converged from the opposing walls into a single file stream to a common radial location. A sorting mechanism is disposed around the outer periphery of the guideplate for receiving the single file stream of coins and for sorting the coins in the stream according to their respective denominations. Various recesses are included in the disc for alleviating problems resulting from coins becoming stacked.

8 Claims, 7 Drawing Sheets

COIN SORTING MECHANISM

CROSS REFERENCE

This is a continuation of U.S. patent application "Coin Sorting Mechanism," Ser. No. 07/614,611, filed on Nov. 13, 1990, which is a continuation-in-part of U.S. patent application "Coin Sorting Mechanism," Ser. No. 07/323,271, filed on Mar. 14, 1989 issued as U.S. Pat. Nos. 5,106,338 and 5,009,627, respectively.

BACKGROUND OF THE INVENTION

1. Field of the Invention

The present invention relates generally to coin sorting devices and, more particularly, to coin sorters of the type which use a resilient rotating disc and a stationary sorting head for sorting coins of mixed denominations.

2. Description of the Related Art

In coin sorters of the foregoing type, coins are pressed into a resilient disc for positive control throughout referencing, sorting and ejection movements. Such positive control permits the coin sorter to be quickly stopped by braking of the rotation of the resilient disc when a preselected number of coins of a selected denomination have been ejected from the sorter. Positive control also permits the sorter to be relatively compact yet operate at high speed.

A disadvantage of obtaining positive control of coins by pressing the coins into engagement with a sorting head is the possibility of stacked or "double coins" impeding the flow of unstacked or "single coins" through the sorter. A "double coin" condition occurs when two thin coins are engaged one on top of the other between the resilient disc and the sorting head. Although means have been provided for breaking up the "double coins" before the coins are referenced, such means have been unreliable for cases when the "double coin" has the same thickness as a "single coin" of another denomination, and a failure to break a "double coin" before referencing causes the chance of miss-sorting to become significant. The means for breaking up the stacked or double coins has also unduly limited the speed of the sorter by causing, in many instances, more than just one of the two coins in each "double coin" to be recirculated, and these recirculated coins have interfered with the feeding of single coins to the referencing means.

Another disadvantage of coin sorting using such positive control is present when the diameter (or width) of one coin denomination is about equal to twice the width of another coin denomination. In this situation, the coins can be missorted as a result of being guided through the referencing means by other coins and never becoming referenced. Although a number of solutions have been previously attempted, all have fallen short of removing the missorting problem.

Accordingly, it is an object of the present invention to provide a coin sorting device which overcomes the aforementioned deficiencies.

SUMMARY OF THE INVENTION

The present invention avoids miss-sorting and loss of sorting speed by breaking up stacked or "double coins" in such a way that one coin in each double coin is recirculated and the other is directed to a referencing means. The referencing means, for example, recirculates coins that fail to become referenced due to a high density of coins reaching the referencing means. Since "double coins" are broken up before they reach the referencing means, the possibility of miss-sorting is greatly reduced. Moreover, the means for breaking up the double coins also includes a recirculating means separate from the recirculating means of the referencing means, and therefore the presence of double coins does not reduce the sorting speed.

To increase the sorting speed when small thin coins are mixed with large thick coins, the large thick coins are preselected before being referenced together with the coins of other denominations. Preferably, thick coins which are not initially referenced to an extreme outward radial position are recirculated prior to reaching the means for breaking up double coins, since such thick coins would otherwise hinder the flow of thin coins to the referencing means.

In one embodiment of the present invention, a coin sorter sorts coins of at least first and second denominations according to their denominations. The first coin denomination defines coins which are thicker and wider than the coins of the second denomination. The coin sorter includes a rotatably mounted coin carrying disk having a resilient surface onto which coins may be fed, a mechanism for rotating the coin carrying disk, and a guideplate having a central opening in a configured surface position closely adjacent to the disk and over the resilient surface. The configured surface includes an inner recess area for receiving coins of all denominations from the central opening and for allowing those coins to move radially outward; and a channel area, responsive to the outwardly moving coins, having a width wider than the width of the coins of the first denomination and a depth and opposing walls arranged and constructed such that nonstacked coins of the first and second denominations are respectively guided along and subsequently converged from the opposing walls into a single file stream to a common radial location. Sorting means is disposed around the outer periphery of the guideplate for receiving the single file stream of coins and for sorting the coins in the stream according to their respective denominations.

Preferably, the channel area includes an area having a width wider than the width of the first denomination and an outer wall that is directed at least partially radially inward for guiding the coins of the second denomination, and an opposing inner wall having a section for guiding the coins of the first denomination to a radial referencing position from which the coins of the first denomination are no longer guided by the inner wall section, such that the coins of the first and second denominations converge from the opposing walls to a substantially common radial location. A narrow ramp may be positioned adjacent the substantially common radial location to pinch the coins of all denominations into the disk such that the pinched coins are moved from the substantially common radial location by the rotating disk. A recycling recess may be located adjacent the narrow ramp to recycle coins that are not pinched by the narrow ramp.

Figure 1:
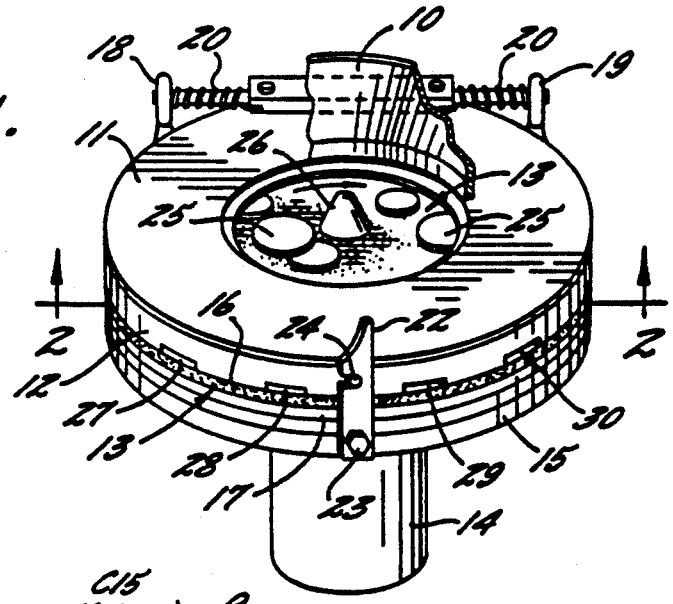
FIG. 1 is perspective view of a coin sorter embodying the present invention, with a top portion thereof broken away to show internal structure.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

DESCRIPTION OF THE PREFERRED EMBODIMENTS

Turning now to the drawings and referring first to FIG. 1, a hopper 10 receives coins of mixed denominations and feeds them through central openings in a housing 11 and an annular sorting head or guide plate 12 inside or underneath the housing. As the coins pass through these openings, they are deposited on the top surface of a rotatable disc 13. This disc 13 is mounted for rotation on a stub shaft (not shown) and driven by an electric motor 14 mounted to a base plate 15. The disc 13 comprises a resilient pad 16 bonded to the top surface of a solid metal disc 17. The top surface of the resilient pad 16 is preferably covered with a durable fabric bonded to the pad itself, which is preferably made of a resilient rubber or polymeric material.

The top surface of the resilient pad 16 is preferably spaced from the lower surface of the sorting head 12 by a gap of about 0.005 inches (0.13 mm). The gap is set around the circumference of the sorting head 12 by a three point mounting arrangement including a pair of rear pivots 18, 19 loaded by respective torsion springs 21, 22 which tend to elevate the forward portion of the sorting head. During normal operation, however, the forward portion of the sorting head 12 is held in position by a latch 22 which is pivotally mounted to the frame 15 by a bolt 23. The latch 22 engages a pin 24 secured to the sorting head. For gaining access to the opposing surfaces of the resilient pad 16 and the sorting head, the latch is pivoted to disengage the pin 24, and the forward portion of the sorting head is raised to an upward position (not shown) by the torsion springs 20, 21. This is occasionally done, for example, to inspect the sorting head 12 or disc 13 for unusual wear or to remove foreign objects.

As the disc 13 is rotated, the coins 25 deposited on the top surface thereof tend to slide outwardly over the surface of the pad due to centrifugal force. The coins 25, for example, are initially displaced from the center of the disc 13 by a cone 26, and therefore are subjected to sufficient centrifugal force to overcome their static friction with the upper surface of the disc. As the coins move outwardly, those coins which are lying flat on the pad enter the gap between the pad surface and the guide plate 12 because the underside of the inner periphery of this plate is spaced above the pad 16 by a distance which is slightly greater than the thickness of the thickest coin. As further described below, the coins are sorted into their respective denominations, and the coins for each denomination issue from a respective exit slot, such as the slots 27, 28, 29 and 30, for nickels, quarters, dollars, and half-dollars, respectively.

In general, the coins for any given currency are sorted by the variation in diameter for the various denominations, although in many cases it is desirable or necessary to also sort by variation in thickness. The coins circulate between the sorting head and the rotating disc until a single-file stream of coins is obtained. One edge of the coins in this stream of coins is aligned, and possibly adjusted somewhat based on coin thickness, so that the other edge of the coins is subsequently gaged against gaging surfaces for directing the coins to the exit slots for the respective denominations. Preferably most of the aligning, referencing, sorting, and ejecting operations are performed when the coins are pressed into engagement with the lower surface of the sorting head 12. In other words, the distance between the lower surfaces of the sorting head 12 which the passages conveying the coins and the upper surface of the rotating disc 13 will be less than the thickness of the coins being conveyed. As introduced above, such positive control permits the coin sorter to be quickly stopped by braking of the rotation of the disc 13 when a preselected number of coins of a selected denomination have been ejected from the sorter. Positive control also permits the sorter to be relatively compact yet operate at high speed. The positive control, for example, permits the single file stream of coins to be relatively dense, and ensures that each coin in this stream can be directed to a respective exit slot instead, for example, of being recirculated.

As introduced above, a disadvantage of obtaining positive control of coins by pressing the coins into engagement with a sorting head is the possibility of stacked or "double coins" impeding the flow of unstacked or "single coins" through the sorter. This problem is especially severe for sorting foreign currency in which the "double coin" has the same thickness as a "single coin" of another denomination. A worst case, for example, occurs for Dutch currency in which the Dutch "dime" has a thickness of 0.053 inches (1.35 mm) and a diameter of 0.591 inches (15.0 mm), and the Dutch "5 gilder" coin has a thickness of 0.105 inches (2.67 mm) and a diameter of 0.925 inches (23.5 mm). When sorting U.S. currency, the "double coin" problem can cause a noticeable loss of sorting speed and relatively high possibility of miss-sort when sorting coinage consisting essentially of dimes.

Figure 2:
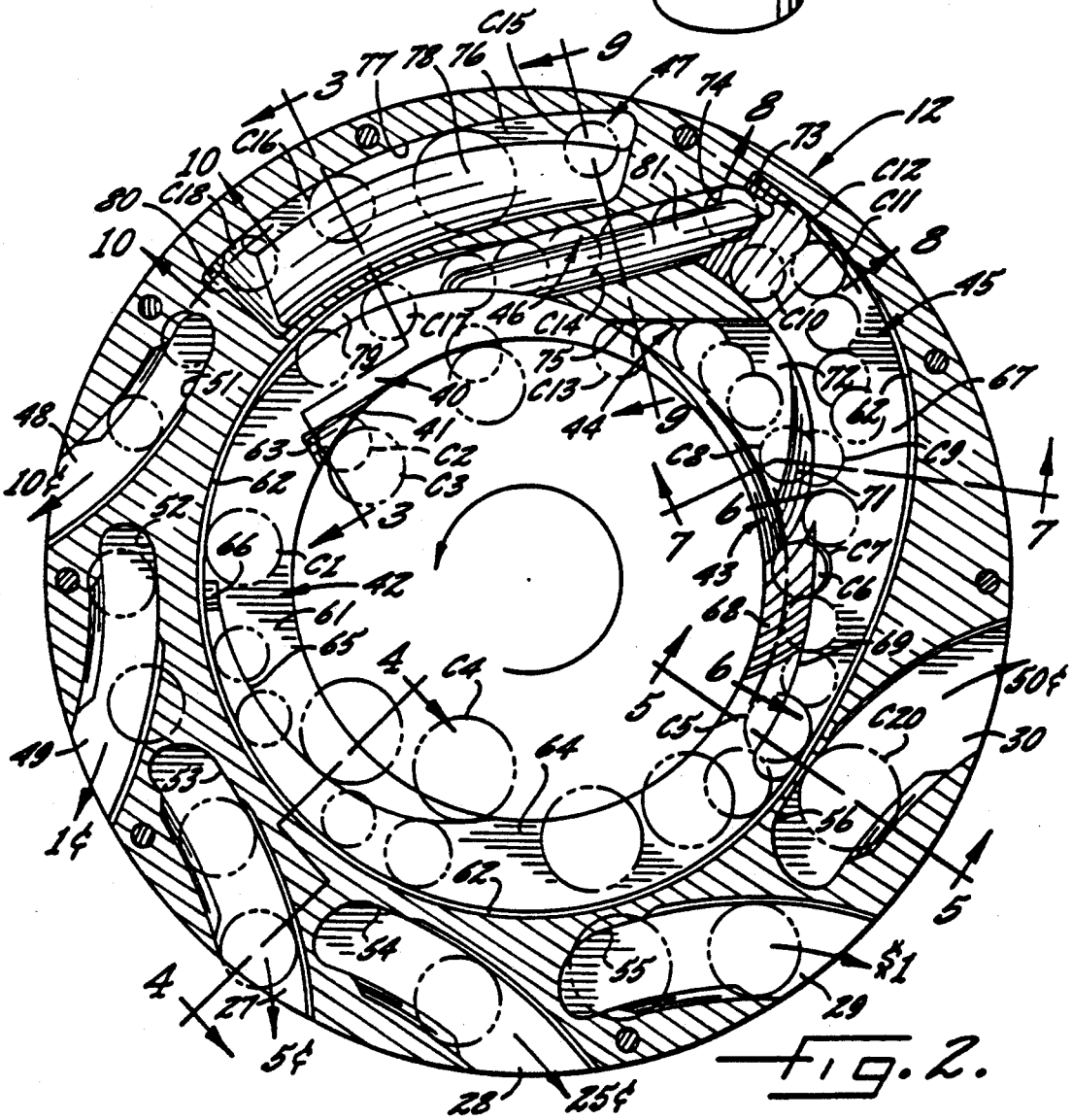
FIG. 2 is an enlarged horizontal section taken generally along the line 2—2 in FIG. 1 to show the configuration of the underside of the sorting head or guide plate, with hatching added to the lowermost surface of the guide plate to more clearly identify the recessed areas, and with various coins superimposed thereon to illustrate the functions of the guide plate.

Turning now to FIG. 2, there is shown a bottom view of the preferred sorting head 12 including various channels and other means especially designed for high-speed sorting with positive control of the coins, yet avoiding the "double coin" problem. With an eleven-inch sorting head 12, it is possible to rotate the disc 13 at about 200 RPM, stop the rotation in about 20 milliseconds using an electromagnetic friction brake (not shown), and sort thousands of coins per minute, depending upon the diameter of the coins being sorted.

It should be kept in mind that the circulation of the coins, which is clockwise in FIG. 1, appears counterclockwise in FIG. 2 because FIG. 2 is a bottom view. The various means operating upon the circulating coins include an entrance region 40, means 41 for stripping "shingled" coins, means 42 for selecting thick coins, means 43 for breaking up stacked coins including first means 44 for recirculating coins, first referencing means 45 including means 46 for recirculating coins, second referencing means 47, and the exit means 48, 49, 27, 28, 29, 30 including respective gaging means 51, 52, 53, 54, 55, and 56 for six different coin denominations, such as dimes, pennies, nickels, quarters, dollars and half-dollars.

Considering first the entrance region 40, the outwardly moving coins initially enter under a semiannular region underneath a planar surface 61 formed in the underside of the guide plate or sorting head 12. Coin C1, superimposed on the bottom plan view of the guide plate in FIG. 2 is an example of a coin which has entered the entrance region 40. The planar surface 61 is spaced above the lowermost (cross-hatched) surface of the sorting head 12 by about 0.110 inches (2.79 mm) and therefore is spaced above the top surface of the pad 16 by a distance of about 0.115 inches (2.92 mm) which is greater than the thickness of the thickest denomination of coin.

Free radial movement of the coins within the entrance region 40 is terminated when they engage a wall 62, though the coins continue to move circumferentially along the wall 62 by the rotational movement of the pad 16, as indicated by the central arrow in the counterclockwise direction in FIG. 2. The wall 62 is preferably tapered to minimize abrasion by minimizing the area of contact between the coins and the recess wall.

To prevent the entrance region 40 from becoming blocked by shingled coins, the planar region 61 is provided with an inclined surface 41 forming a wall or step 63 for engaging the upper most coin in a shingled pair. In FIG. 2, for example, an upper coin C2 is shingled over a lower coin C3. As further shown in FIG. 3, movement of the upper coin C2 is limited by the wall 63 so that the upper coin C2 is forced off of the lower coin C3 as the lower coin is moved by the rotating disc 13.

Figure 4:
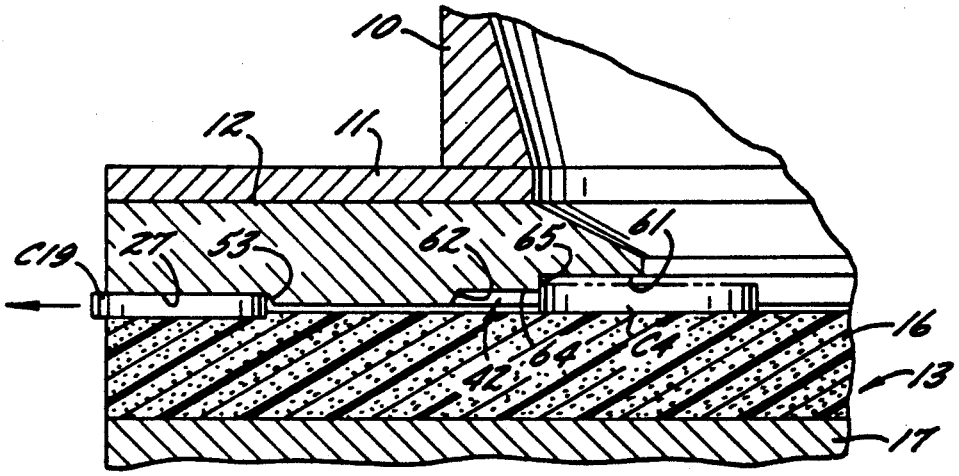
FIG. 4 is an enlarged section taken generally along line 4—4 in FIG. 2, showing in full elevation a nickel registered with an ejection recess.

Returning to FIG. 2, the circulating coins in the entrance region 40, such as the coin C1, are next directed to the means 42 for selecting thick coins. This means 42 includes a surface 64 recessed into the sorting head 12 at a depth of 0.070 inches (1.78 mm) from the lower (cross-hatched) surface of the sorting head. Therefore, a step or wall 65 is formed between the surface 61 of the entrance region 40 and the surface 64. The distance between the surface 64 and the upper surface of the disc 13 is therefore about 0.075 inches so that all but relatively thick coins between the surface 64 and the disc 13 are held by pad pressure. To initially engage such thick coins, an initial portion of the surface 64 is formed with a ramp 66 located adjacent to the wall 62. Therefore, as the disc 13 rotates, thick coins in the entrance region that are next to the wall 62 are engaged by the ramp 66 and thereafter their radial position is fixed by pressure between the disc and the surface 64. Thick coins which fail to initially engage the ramp 66, however, engage the wall 65 and are therefore recirculated back within the central region of the sorting head. This is illustrated, for example, in FIG. 4 for the coin C4. This initial selecting and positioning of the thick coins prevents misaligned thick coins from hindering the flow of coins to the first referencing means (45 in FIG. 2).

Figure 5:
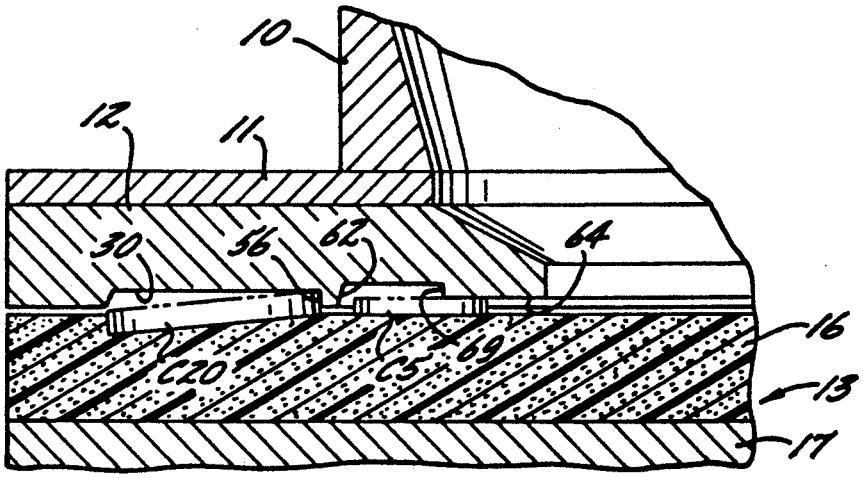
FIG. 5 is an enlarged section taken generally along line 5—5 in FIG. 2.

Returning now to FIG. 2, it should be apparent that the ramp 66 in the means 42 for selecting the thick coins can also engage a pair or stack of thin coins. Such a stack or pair of thin coins will be carried under pad pressure between the surface 64 and the rotating disc 13. In the same manner as a thick coin, such a pair of stack coins will have its radial position fixed and will be carried toward the first referencing means 45. This first referencing means 45 is a surface 67 located at a depth of about 0.110 inches (2.79 mm) which is large enough to permit even the thickest coin to pass freely between the sorting head 12 and the rotating disc 13, so that the coins are lined up against the outer wall 62 by centrifugal force. To aid disengagement of the thick coins from the surface 64, the surface 64 is terminated by a ramp 68, which has an outermost edge terminating in a wall 69 between the surface 64 and the surface 67 and which lifts thicker coins and stacked coins into wall 71. Wall 69 is further shown in FIG. 5, which illustrates the engagement of the terminal portion of the surface 64 with a portion of a coin such as the coin C5.

In many cases, however, centrifugal force is insufficient to provide a steady flow of coins to the first referencing means 45. Such is the case for stacked or double coins, such as the pair of dimes C6 and C7. Therefore there is provided means 43 for breaking up the double coins, including means defining a wall 71 presented to the upper most of the stacked coins, causing in most cases the upper most coin to be deflected towards the first referencing means 45. The wall 71 also deflects any thick coins toward the first referencing means 45.

Figure 6:
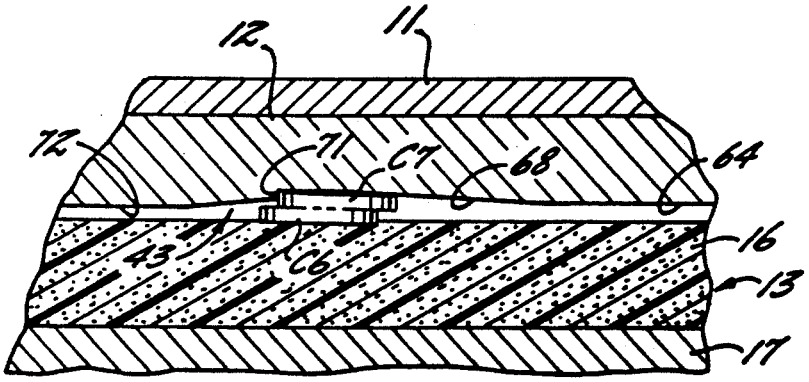
FIG. 6 is an enlarged section taken generally along line 6—6 in FIG. 2, showing in full elevation a pair of stacked dimes just prior to being broken up.
Figure 7:
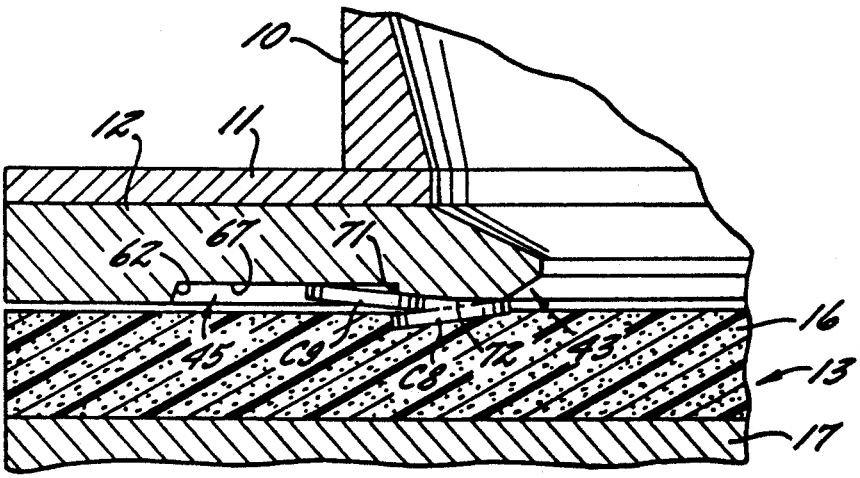
FIG. 7 is an enlarged section taken generally along line 7—7 in FIG. 2, showing in full elevation a pair of stacked dimes being broken up.

The breaking up of a pair of stacked dimes is further illustrated in FIG. 6 and 7. In FIG. 6 the upper dime C7 engages the wall 71 as the rotating disc 13 continues to circulate the lower dime C6. Therefore, the upper dime C7 is stripped from the lower dime C6. Furthermore, in accordance with an important aspect of the present invention, the lower dime C6 becomes engaged between the rotating disc 17 and a surface 72 in order to carry the lower dime to a first recirculating means (44 in FIG. 2).

As further shown in FIG. 7, it is possible for a small portion of a coin such as a coin C8 to be engaged by the surface 72 so that an upper coin C9 could still be trapped between the lower coin C8 and the sorting head 12. In this situation, it is possible for both coins to be recirculated by the first recirculating means (44 in FIG. 2) or possibly the upper coin C9 will be recirculated by the second recirculating means (46 in FIG. 2). For conditions such as shown in FIG. 7, the use of both a first and second recirculating means ensures an uninterrupted flow of coins to the first referencing means (45 in FIG. 2) and a very low probability of miss-sorting due to stacked or double coins.

Figure 8:
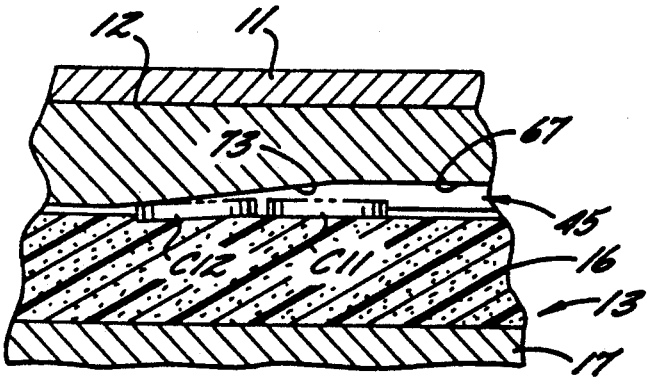
FIG. 8 is an enlarged section taken generally along line 8—8 in FIG. 2, showing in full elevation a pair of dimes being fed to a first registering means.

Returning now to FIG. 2, the first means 45 for referencing the coins obtains a single-file stream of coins directed against the outer wall 62 and leading up to a ramp 73. As further shown in FIG. 8, for example, coins C11 and C12 are aligned against the wall 62 and become engaged between the rotating disc 13 and the sorting head 12. At the terminal end of the ramp 73, the coins become firmly pressed into the pad 16 and are carried forward to the second referencing means (47 in FIG. 2).

Returning now to FIG. 2, it should be apparent that a coin such as the coin C12 will be carried forward to the second referencing means 47 so long as a portion of the coin is engaged by the terminal portion of the ramp 73. If a coin is not sufficiently close to the wall 62 so as to be engaged by the terminal portion of this ramp 73, then the coin strikes a wall 74 defined by the second recirculating means 46, and that coin is recirculated back to the entrance region 40.

Figure 9:
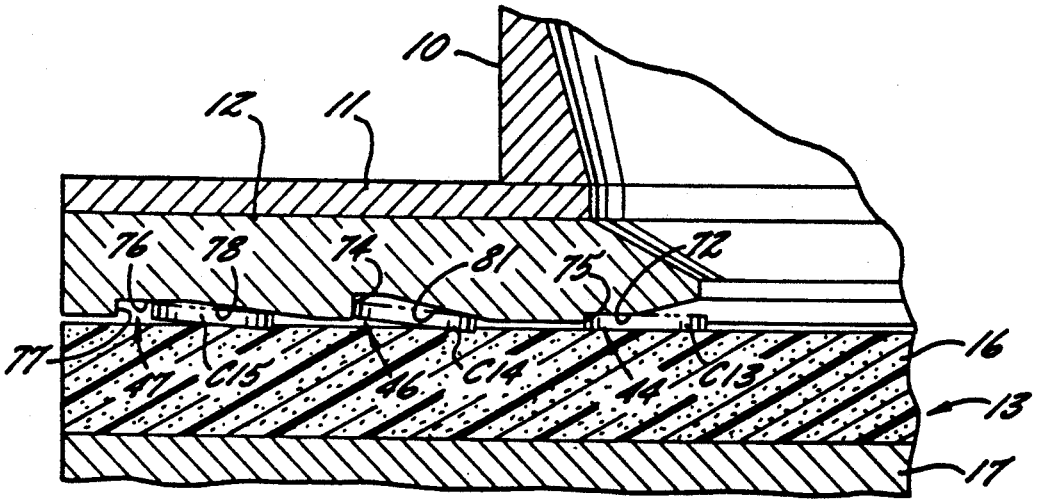
FIG. 9 is an enlarged section taken generally along line 9—9 in FIG. 2, showing in full elevation a first dime in a first recirculating means, a second dime in a second recirculating means, and a third dime in a second registering means.

Turning now to FIG. 9, it is seen that the first recirculating means 44, the second recirculating means 46 and the second referencing means 47 are defined at successive positions in the sorting head 12. It should be apparent that the first recirculating means 44, as well as the second recirculating means 46, recirculate the coins under positive control of pad pressure. The second referencing means 47 also uses positive control of the coins to align the outer most edge of the coins with a gaging wall 77. For this purpose, the second referencing means 47 includes a surface 76, for example, at 0.110 inches (1.27 mm) from the bottom surface of the sorting head 12, and a ramp 78 which engages the inner edge portions of the coins, such as the coin C15.

Figure 3:
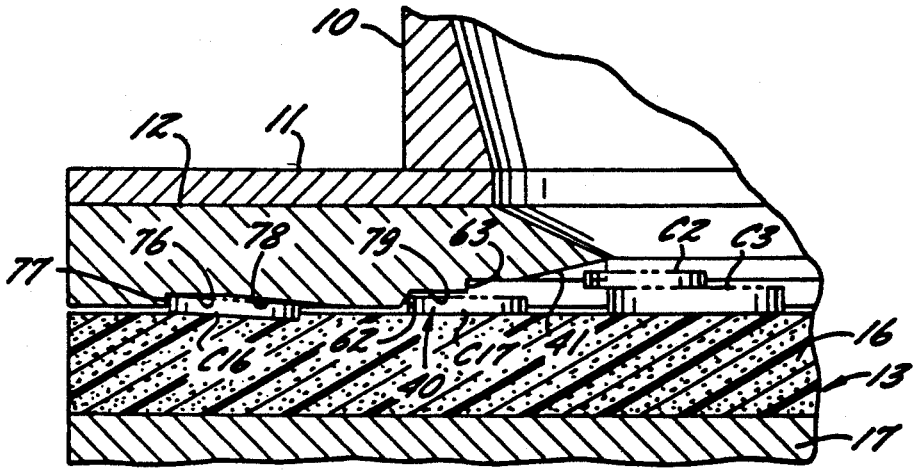
FIG. 3 is an enlarged section taken generally along line 3—3 in FIG. 2, showing the coins in full elevation.

As better shown in FIG. 2, the initial portion of the gaging wall 77 is along a spiral path with respect to the center of the sorting head 12 and the sorting disc 13, so that as the coins are positively driven in the circumferential direction by the rotating disc 13, the outer edge of the coins engages the gaging wall 77 and are forced slightly radially inward to a precise gaging radius, as shown for the coin C16 in FIG. 3. FIG. 3 further shows a coin C17 having been ejected from the second recirculating means 46. Also shown in FIG. 3 is a surface 79 extending from the second recirculating means and which is located, for example, at 0.065 inches (1.65 mm) above the lower (cross-hatched) surface of sorting head 12.

Figure 10:
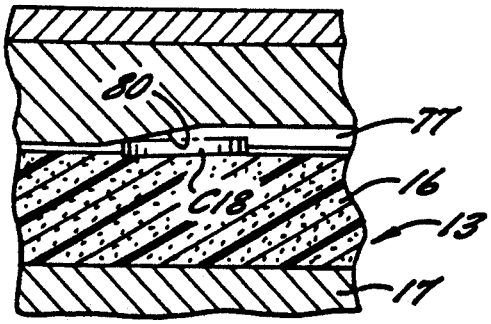
FIG. 10 is an enlarged section taken generally along line 10—10 in FIG. 2, showing a final registering operation being performed by the second registering means.

The second referencing means 47 terminates with a slight ramp 80 causing the coins to be firmly pressed into the pad 16 on the rotating disc with their outer most edges aligned with the gaging radius provided by the gaging wall 77. This is illustrated in FIG. 10 for the coin C18. At the terminal end of the ramp 80 the coins are gripped between the guide plate 12 and the resilient pad 16 with the maximum compressive force. This ensures that the coins are held securely in the new radial position determined by the wall 77 of the second referencing means (47 in FIG. 2).

Returning now to FIG. 2, the sorting head 12 further includes sorting means comprising a series of ejection recesses 48, 49, 27, 28, 29, 30 spaced circumferentially around the outer periphery of the plate, with the innermost edges of successive slots located progressively farther away from the common radial location of the outer edges of all the coins for receiving and ejecting coins in order of increasing diameter. The width of each ejection recess preferably is smaller than the diameter of the coin to be received and ejected by that particular recess, and the surface of the guide plate adjacent the radially outer edge of each ejection recess presses the outer portions of the coins received by that recess into the resilient pad so that the inner edges of those coins are tilted upwardly into the recess. The ejection recesses extend outwardly to the periphery of the guide plate so that the inner edges of these recesses guide the tilted coins outwardly and eventually eject those coins from between the guide plate 12 and the resilient pad 16.

It has been found that the coins can be reliably sorted and ejected at high throughput rates, while being pressed into the resilient pad, without the use of auxiliary coin-tilting devices such as depressors or plows. More specifically, the innermost edges of the ejection recesses are positioned so that the inner edge of a coin of only one particular denomination can enter each recess; the coins of all other remaining denominations extend inwardly beyond the innermost edge of that particular recess so that the inner edges of those coins cannot enter the recess. Thus, all the coins except the dimes bypass the recess 49.

For example, the first ejection recess 48 is intended to discharge only dimes, and thus the innermost edge 51 of this recess is located at a radius that is spaced inwardly from the radius of the gaging wall 77 by a distance that is only slightly greater than the diameter of a dime. Consequently, only dimes can enter the recess 48. Because the outer edges of all denominations of coins are located at the same radial position when they leave the second referencing means 47, the inner edges of the pennies, nickels, quarters, dollars and half dollars all extend inwardly beyond the innermost edge of the recess 48, thereby preventing these coins from entering that particular recess.

At recess 49, the inner edges of only pennies are located close enough to the periphery of the sorting head 12 to enter the recess. The inner edges of all the larger coins extend inwardly beyond the innermost edge 52 of the recess 49 so that they remain gripped between the guide plate and the resilient pad. Consequently, all the coins except the pennies continue to be rotated past the recess 52.

Similarly, only nickels enter the ejection recess 27, only the quarters enter the recess 28, only the dollars (e.g., enter the recess 29, and only the half dollars enter the recess 30.

Because each coin is gripped between the sorting head 12 and the resilient pad 16 throughout its movement through the ejection recess, the coins are under positive control at all times. Thus, any coin can be stopped at any point along the length of its ejection recess, even when the coin is already partially projecting beyond the outer periphery of the guide plate. Consequently, no matter when the rotating disc is stopped (e.g., in response to the counting of a preselected number of coins of a particular denomination), those coins which are already within the various ejection recesses can be retained within the sorting head until the disc is re-started for the next counting operation.

Figure 11:
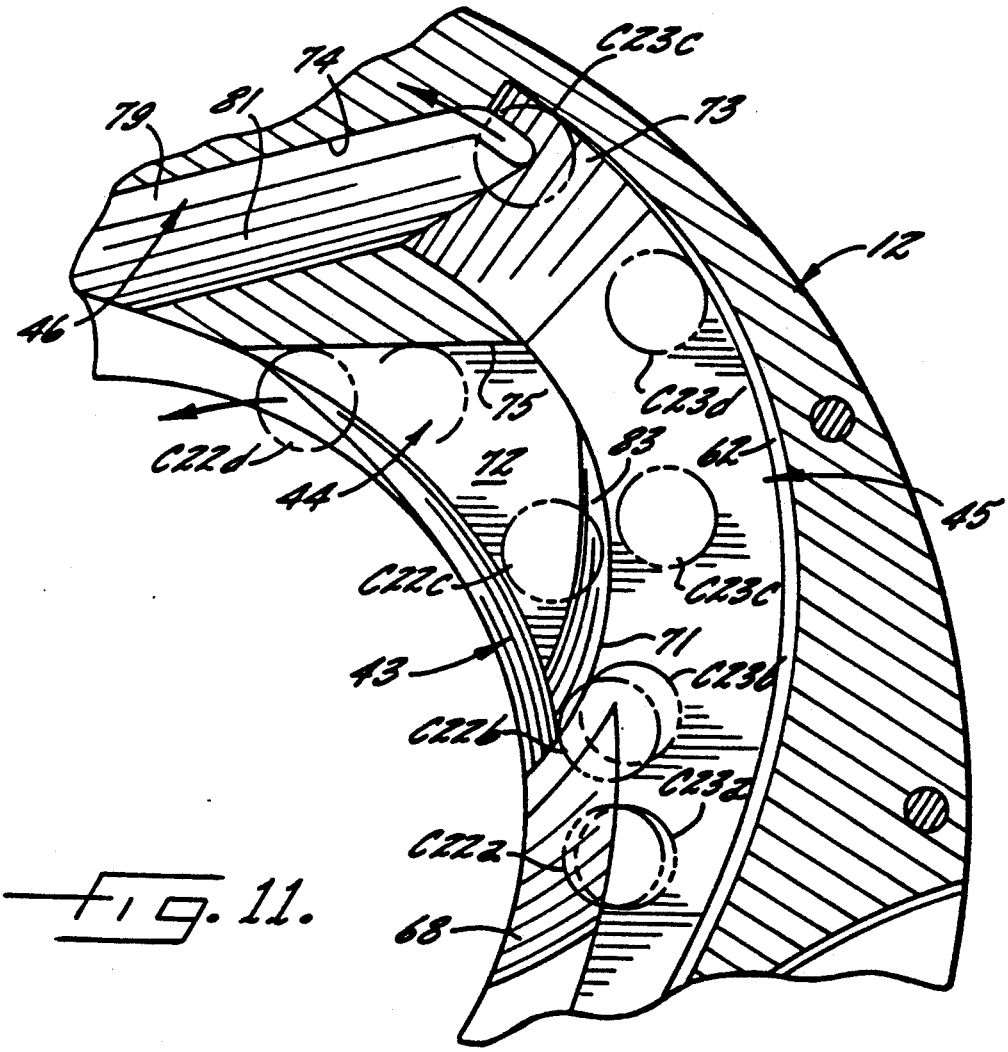
FIG. 11 is a right-hand portion of FIG. 2 with certain coins superimposed thereon to illustrate the splitting and recycling a stacked pair of dimes.

Turning now to FIG. 11, there is shown an enlarged portion of FIG. 2 to more clearly illustrate the operation of the means 43 for breaking up double coins and its relationship to the first means 44 for recirculating coins, the first referencing means 45 and the second means 46 for recirculating coins. Shown in FIG. 11 is the typical case in which a stacked pair of coins including a lower coin C22*a* and an upper coin C23*a* are carried below the ramp 68 and in which the upper coin C23*b* becomes engaged with the wall 71 of the means 43 for breaking up the double coins. The lower coin C22*b* becomes engaged under the surface (or coin stripping region) 72 and is carried in a circumferential direction to the position C22*c*. Once the double coins are broken up, the upper coin is deflected by the wall 71, which has a height of approximately 0.050 inches along the outer radial edge of most of the ramp 83, although there is a gap of approximately 0.065 inches (1.40 mm) between the lower edge of the wall and the upper surface of the rotating disc 13. As shown in FIG. 11, the deflected coin is carried by centrifugal force to position C23*d* and becomes engaged at the position C23*e* by the ramp 73 of the first referencing means 45.

It should be apparent that in the case of FIG. 11, the lower coin of a pair of stacked coins is recirculated by the first recirculating means 44. This is desirable because in the case of double coins, the coins would otherwise be fed to the first referencing means 45 at a rate twice as fast as the rate at which the referencing means can handle them. Although the referencing means 45 does have a second means 46 for rejecting excess coins, the reduction in the load of coins upon the second recirculating means prevents stacked coins from impeding the operation of the first referencing means 45 and prevents stacked coins from being fed to the second recirculating means. Such double coins could very well cause a miss-sort because they could be carried up the ramp 73 and over the wall 74 of the second recirculating means.

The use of two separate recirculating means also ensures that both of the coins in a stacked pair are recirculated for the anomalous condition shown in FIG. 7. In such a case, the stacked coins will be broken up by the wall 75 and will both be recirculated by the wall 75, or possibly one will be recirculated by the wall 75 of the first recirculating means and the other will be recirculated by the wall 74 of the second recirculating means 46. In any event, the double coins are broken up without impeding the flow of coins to the first recirculating means, and therefore the possibility of miss-sorting is reduced without reducing the sorting speed.

Figure 12:
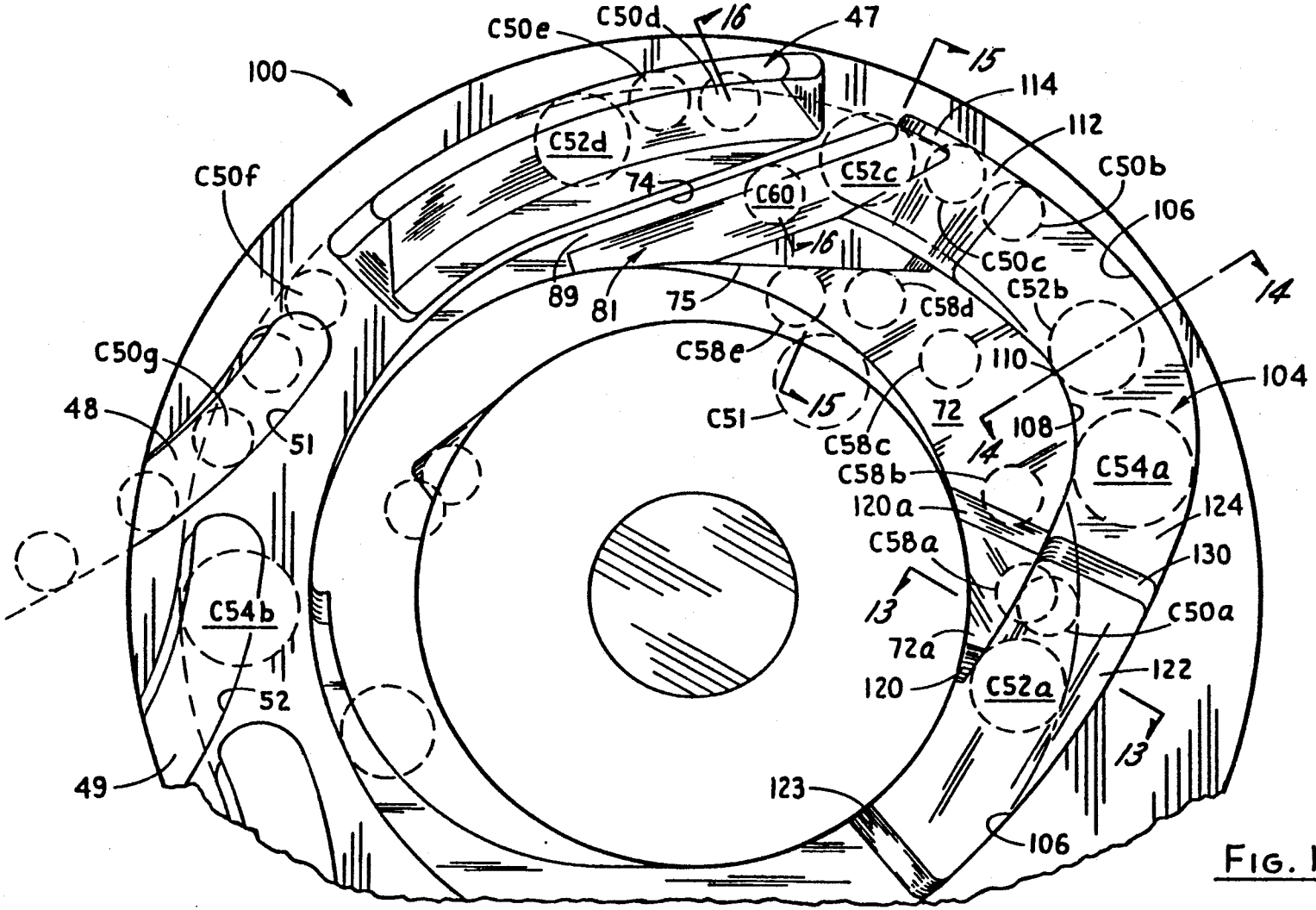
FIG. 12 is a bottom view of the coin sorter head illustrated in FIG. 1, but modified, to improve the sorting for certain coin denominations.
Figure 14:
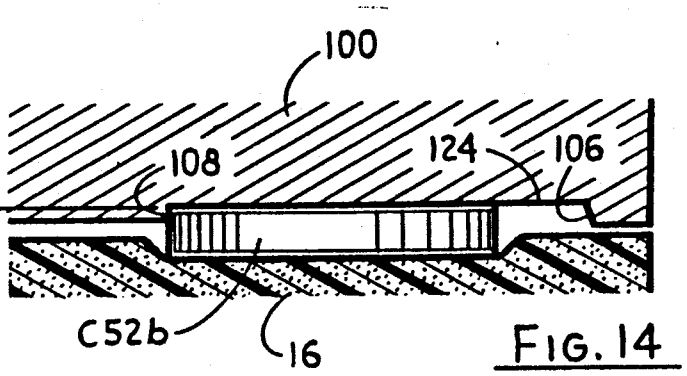
FIG. 14 is an enlarged section taken generally along line 14—14 in FIG. 12.
Figure 13:
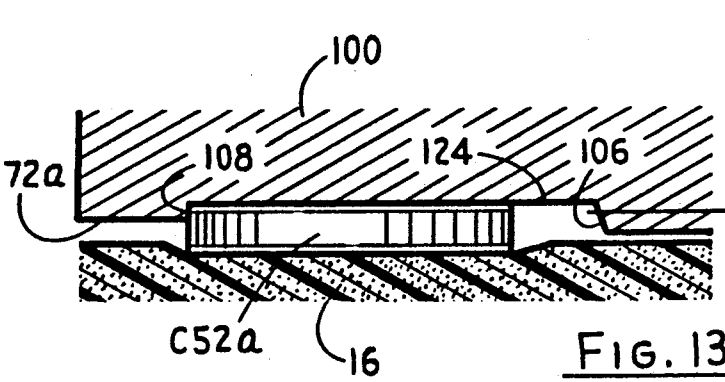
FIG. 13 is an enlarged section taken generally along line 13—13 in FIG. 12.
Figure 15:
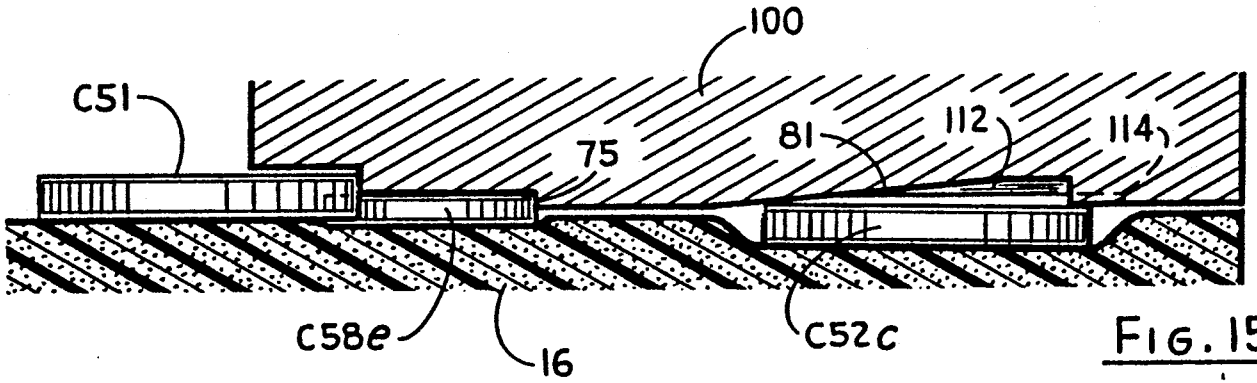
FIG. 15 is an enlarged section taken generally along line 15—15 in FIG. 12.
Figure 16:
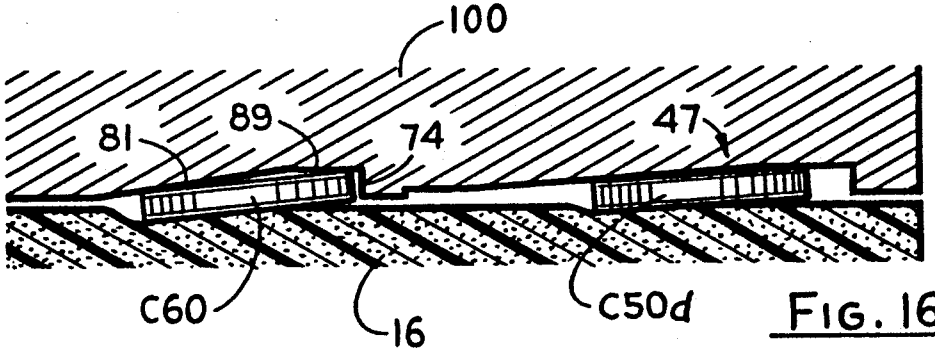
FIG. 16 in an enlarged section taken generally along line 16—16 in FIG. 12.

As an alternative to the sorting head 12 of FIGS. 2 and 11, FIG. 12 illustrates a modified section of the sorting head 12, the primary difference between the sorting head 12 and the sorting head 100 of FIG. 12 concerns the first referencing means 45 of FIG. 2, which has been modified in terms of its shape and depth. As discussed above, the first referencing means (or channel) 45 permits all coins of all denominations to pass freely between the sorting head 12 and the rotating disc 13, so that the coins are lined up against the outer wall 62 by centrifugal force. Unfortunately, in certain situations, coins which are about half the width of other coins can be carried through the channel 45 of FIG. 2, being trapped between and held off the wall 62 by adjacent coins. This can result in an occasional missort if the trapped coin passes over wall 74 and continues to be pressed into the pad 16 and held away from the wall 77. The worst case situation is probably the Dutch "dime", which is about half the diameter of the Dutch 2½ glider. If the dime is forced over the ramp 73 while offset from the wall 62, it is possible that it will not be sorted off the disc by the edge 51 of the recess 48, but rather will be sorted off the disc by encountering one of the other recess edges 52–56.

Turning now to FIG. 12, this problem is addressed by including a channel recess 104 which is sufficiently deep to allow coins C50 having a lesser thickness to be guided along an outer wall 106 by centrifugal force, similar to the movement of coins along the outer wall 62 of FIG. 2, but sufficiently shallow to permit coins C52, C54 having a greater thickness to be pressed between the pad 16 and the sorting head 100, so that they are guided along inner wall 108 as they move through the channel recess 104.

The channel recess 104 includes a section which bends such that coins C52, which are sufficiently thick to be guided by the inner wall 108 but have a width which is less than the width of the channel recess 104, are carried away from the inner wall 108 from a maximum radial location 110 on the inner wall toward a ramp 112, which operates like the ramp 73 of FIG. 2. This configuration in the sorting head 100 allows the coins of all denominations to converge at a narrow ramped finger 114 on the ramp 112, with coins C54 having the largest width being carried between the inner and outer walls, via surface 124, to the ramped finger 114 so as to bring the outer edges of all coins to a generally common radial location. By directing the coins C50 radially inward along the latter portion of the outer wall 106, the probability of coins being offset from the outer wall 106 by adjacent coins and being lead onto the ramped finger 114 is significantly reduced. Any coins C50 which are slightly offset from the outer wall 106 while being lead onto the ramp finger 114 may be accommodated by moving the edge 51 of exit recess 48 radially inward, sufficiently enough to increase the width of the recess 48 to capture offset coins C50 but to prevent the capture of coins of the larger denominations. For sorting Dutch coins, the width of the ramp finger 114 may be about 0.140 inch.

Other differences between the sorting heads 12 and 100 concern the introduction of coins into the channel recess 104, a variation in the depth of the channel recess 104, and the rejection of coins in the rejection recess 81 (FIGS. 11 and 12). Coins are introduced into the channel recess 104 by the thinner coins moving radially outward via centrifugal force, or by the thicker coin(s) C52*a* following concentricity via pad pressure. As with coins C8 and C9 of FIGS. 2 and 7, stacked coins C58*a* and C50*a* of FIG. 12 are separated at wall 108 such that the lower coin 58*a* is carried against surface 72*a*. The progression of the lower coin C58*a* is depicted by its positions at C58*b*, C58*c*, C58*d* and C58*e*. Moreover, at the beginning of the wall 108 (equivalent to the wall 71 of FIG. 2), a ramp 120 is used to recycle coins not fully between the outer and inner walls 106 and 108 and under the sorting head 100. As shown in FIG. 12, no other means, such as ramp 68 of FIG. 2, is needed to provide a proper introduction of the coins into the channel recess 104.

With respect to the channel recess 104, it is further recessed over a region 122 of sufficient length to allow the coins C54 of the widest denomination to move to the outer wall 106 by centrifugal force. This allows coins C54 of the widest denomination to move freely into the channel recess 104 towards its outer wall 106 without being pressed between the resilient pad 16 and the sorting head 100 at ramp 120. The inner wall 108 is preferably constructed to follow the contour of the channel recess ceiling. The region 122 of the channel recess 104 is raised into the head 100 by ramps 123 and 130, and the consistent contour at the wall 108 is provided a ramp 120*a*. For example, for Dutch coins, a 0.030 inch step is maintained along the wall 108; and the region 122 may extend clockwise about 32 degrees between ramps 123 and 130 with respect to the center of the sorting head 100 and may be recessed 0.095 inch from the top surface of the resilient disc 13 or 0.090 inch from the lowest point surface of the resilient disc 13; whereas the region on the other side of ramp 123 may be recessed 0.070 inch.

Coins that are not against the outer wall 106 by the time they reach the ramp finger 114 are rejected by the rejection recess 81 along the wall 74 (FIGS. 11 and 12). The recess 81 gradually deepens, so that the height of the wall 74 catches and rejects for recycling stacked coins of all denominations or any configuration of coins that miss ramp ringer 114. At its deepest point 89, the recess 81 is preferably about 1½ times the thickness of the thinnest coin.

Accordingly, the present invention provides a highly accurate coin sorting device which accommodates and sorts coin denominations of even worst case thicknesses and diameters.

What is claimed is:

1. A coin sorter for sorting coins, including coins of at least first and second denominations, in terms of their denomination, wherein said first denomination defines coins which are thicker and wider than the coins of the second denomination, the sorter comprising:

a rotatably mounted coin-carrying disc having a resilient surface onto which coins may be fed;

means for rotating said disc;

a guide plate having a central opening and a configured surface positioned closely adjacent to said disc and over said resilient surface, wherein said configured surface includes:

inner recess means for receiving coins of all denominations from the central opening and allowing the coins to move radially outward, a coin-path area, having a first recessed region which receives the outwardly moving coins and having a second recessed region which receives coins from the first recessed region, said first recessed region including an area that is less shallow than said second recessed region, a coin-stripping region bordered by a coin-guiding wall which is arranged adjacent said second recessed region;

wherein nonstacked coins of the first denomination move through the second recessed region under pressure by the resilient surface along said coin-guiding wall, and stacked coins of the first denomination which are in the second recessed region are moved to the coin-guiding wall where said stacked coins are unstacked such that one of said stacked coins is moved to the coin-stripping region while another of said stacked coins is engaged against said coin-guiding wall.

2. A coin sorter, according to claim 1, wherein the coin-guiding wall is one of two opposing walls of the coin path area.

3. A coin sorter, according to claim 1, wherein the coin path area includes respective portions that are substantially parallel and that are partially directed radially inward along a direction of coin movement.

4. A coin sorter, according to claim 1, wherein the second recessed region is constructed and arranged to pinch coins of the first denomination and to allow coins of the second denomination to move radially outward by centrifugal force.

5. A coin sorter for sorting coins, including coins of at least first and second denominations, in terms of their denomination, wherein said first denomination defines coins which are thicker than the coins of the second denomination, the sorter comprising:

a rotatably mounted coin-carrying disc having a resilient surface onto which coins may be fed;

means for rotating said disc;

a guide plate having a central opening and a configured surface positioned closely adjacent to said disc and over said resilient surface, wherein said configured surface includes:

inner means for receiving coins of all denominations from the central opening and allowing the coins to move radially outward, a coin-path are having opposing inner and outer walls defining a first recessed region which receives the outwardly moving coins and having a second recessed region which receives coins from the first recessed region, said first recessed region including an area that is less shallow than said second recessed region, a coin-stripping region bordered at least in part by the inner wall which is arranged adjacent said second recessed region;

wherein the first recessed region receives the outwardly moving coins and the second recessed region receives coins from the first recessed region, and nonstacked coins of the first denomination move through the second recessed region under pressure by the resilient surface along said inner wall and stacked coins of the first denomination which are in the second recessed region are moved to the inner wall where said stacked coins are unstacked such that one of said stacked coins is moved to the coin-stripping region while another of said stacked coins is engaged against said inner wall.

6. A coin sorter, according to claim 5, wherein nonstacked coins of the first denomination guided under pad pressure along the inner wall and nonstacked coins of the second denomination guided by the outer wall are converged from said opposing inner and outer walls such said nonstacked coins of said first and second denominations move into a single-file stream at a generally common radial location.

7. A coin sorter, according to claim 5, further including peripheral means disposed around the outer periphery of said guide plate for receiving and sorting said nonstacked coins of the first and second denominations according to their respective denominations.

8. A coin sorter for sorting coins, including coins of at least first and second denominations, in terms of their denominations, wherein said first denomination defines coins which are thicker and wider than the coins of the second denomination, the sorter comprising:

a rotatably mounted coin-carrying disc having a resilient surface onto which coins may be fed;

means for rotating said disc;

a guide plate having a central opening and a configured surface positioned closely adjacent to said disc and over said resilient surface, wherein said configured surface includes:

inner recess means for receiving coins of all denominations from the central opening and allowing the coins to move radially outward, a coin-path area having opposing inner and outer walls a first recessed region which receives the outwardly moving coins and a second recessed region which receives coins from the first recessed region, said first recessed region including an area that is less shallow than said second recessed region, a coin-stripping region bordered by the inner wall which is arranged adjacent said second recessed region, wherein the first recessed region receives the outwardly moving coins and the second recessed region receives coins from the first recessed region, and nonstacked coins of the first denomination move through the second recessed region under pressure by the resilient surface along the inner wall, and stacked coins of the first denomination which are in the second recessed region are moved to the inner wall where said stacked coins are unstacked such that one of said stacked coins is moved to the coin-stripping region while another of said stacked coins is engaged against the inner wall;

peripheral means disposed around the outer periphery of said guide plate, wherein nonstacked coins of the first denomination guided under pad pressure along the inner wall and nonstacked coins of the second denomination guided by the outer wall are moved from said opposing inner and outer walls into a single-file stream at a generally common reaial location from which said peripheral means sorts said nonstacked coins of the first and second denominations according to their respective denominations.

* * * * *